US006707280B1

(12) United States Patent
Liu et al.

(10) Patent No.: US 6,707,280 B1
(45) Date of Patent: Mar. 16, 2004

(54) BIDIRECTIONAL VOLTAGE REGULATOR SOURCING AND SINKING CURRENT FOR LINE TERMINATION

(75) Inventors: Kwang H. Liu, Sunnyvale, CA (US); Sorin L. Negru, San Jose, CA (US); Fu-Yuan Shih, Taipei (TW)

(73) Assignee: Arques Technology, Inc., Sunnyvale, CA (US)

( * ) Notice: Subject to any disclaimer, the term of this patent is extended or adjusted under 35 U.S.C. 154(b) by 0 days.

(21) Appl. No.: 10/238,078

(22) Filed: Sep. 9, 2002

(51) Int. Cl.[7] ..... G05F 1/618

(52) U.S. Cl. ..... 323/224; 323/226; 323/270; 323/274; 363/62

(58) Field of Search ..... 323/224, 226, 323/266, 268, 270, 274, 275; 363/62

(56) References Cited

U.S. PATENT DOCUMENTS 5,216,351 A * 6/1993 Shimoda ..... 323/268
5,262,712 A * 11/1993 Klotzig et al. ..... 323/226
5,608,312 A * 3/1997 Wallace ..... 323/224
6,433,521 B1 * 8/2002 Chen et al. ..... 323/224
6,479,972 B1 * 11/2002 Chen ..... 323/266

* cited by examiner

*Primary Examiner*—Jeffrey Sterrett
(74) *Attorney, Agent, or Firm*—Anthony B. Diepenbrock III; Dechert LLP

(57) ABSTRACT

A voltage regulator for providing a bidirectional current and a regulated voltage to a load. The voltage regulator regulates the output voltage at one half the level of the input voltage using a voltage doubler circuit in reverse. The regulator provides current to the load when the output voltage drops and receives current from the load when the output voltage rises. The voltage regulator is particularly suited to supplying a termination voltage to multiple line drivers in a DDR DRAM system, where the line drives require an active termination voltage to reduce power. Additionally, a pair of linear regulators, one for clamping the output voltage at a predetermined low voltage level and for supplying additional current demanded by the load, and the other for clamping the output voltage at a predetermined high voltage level and for receiving additional current supplied by the load, is included.

11 Claims, 8 Drawing Sheets

BIDIRECTIONAL VOLTAGE REGULATOR SOURCING AND SINKING CURRENT FOR LINE TERMINATION

CROSS-REFERENCE TO RELATED APPLICATIONS

1. Field of the Invention

The present invention generally relates to voltage regulators and more particularly to voltage regulators capable of sinking and sourcing current and regulating an output voltage to one half the level of an input voltage.

2. Description of the Related Art

Today's high speed DRAMS, such as DDR DRAMs, operate at very high clock frequencies. The data lines of a data bus between a CPU and DDR DRAMs require careful design to maintain signal quality, e.g., minimize signal reflection and ringing. This usually entails some form of line termination and matching of the drivers to the line impedance.

FIG. 1A shows a representative data line of a data bus in a DDR DRAM system. The data line 13 has a source resistor $R_s$ 14 of about 10 Ω. In addition, the data line has a termination resistor $R_T$ 15 with a value of about 56 Ω. A line driver 12 operates from a supply voltage of VDDQ 11, typically 2.5 V. A pair of line receivers, exemplified by buffers 16 and 17, is connected to the receiving end of the data bus line 13. The negative input of each buffer 16, 17 is usually connected to a reference voltage 18, whose preferred value is exactly one half of VDDQ, or 1.25V.

When the line driver 12 output is high, i.e., substantially close to 2.5V, the power dissipation of the data bus line is $VDDQ^2/(R_{S+RT})$, or about 95 mW. When the line driver 12 output is low, the power dissipation is 0 Watts. Assuming the line driver 12 has an equal chance of being either high or low, the average power dissipation is about 47.5 mW. If there are 110 such data lines (not uncommon in a large DRAM system), the total power needed for the data bus is about 5.2 Watts.

FIG. 1B shows a termination scheme similar to that of FIG. 1A, except that the termination resistor 25 is connected to a regulated voltage VTT 29, which has a value that is one half of VDDQ level. Line driver 22 is still powered from a voltage VDDQ 21, or 2.5V. The source resistor 24 of data line 23 is 10 Ω. The termination resistor 25 is 56 Ωand buffers 26 and 27 are connected to the receiving end of data bus line 23.

When the line driver 22 output is high, i.e., close to 2.5V, the power dissipation of the data line is $(VDDQ-VTT)^2/(R_S+R_T)$, or about 24 mW. When line driver output is low, i.e., close to 0 V, the power dissipation is $VTT^2/(R_S+R_T)$, or 24 mW. Therefore, the average power dissipation is 24 mW and for 110 similarly terminated lines the total power is about 2.6 Watts.

From the above calculations, it is clear that connecting the termination resistor to a termination voltage of one-half of VDDQ reduces power dissipation by 50%. In a typical DRAM system, with as many as 110 lines, a savings of 2.6 W results, if a high-efficiency regulator is used to generate the termination voltage. However, in order to achieve this power savings, the termination voltage VTT regulator is required to both sink and source current. If there are more low-state lines than high-state lines, the VTT regulator sends (sources) current to the data bus system. On the other hand, if there are more high-state lines than low-state lines, the VTT regulator receives (sinks) current from the data bus system.

FIG. 2 shows a conventional synchronous buck converter 30 for providing a regulated termination voltage VTT. A buck converter 30 includes a operational amplifier (OP-AMP) 33, a PWM controller 34, a pair of MOSFET switches 35 and 36, an inductor 37, and an output capacitor 38. The negative input of OP-AMP 33 is connected to the termination voltage VTT output node 39. Two resistors 31 and 32, each having a typical value of 51 kΩ, are connected between the VDDQ supply voltage and ground and the positive input of OP-AMP 33 connects to the junction of the resistors 31 and 32. This causes the positive input of the OP-AMP 33 to have a voltage of one half of VDDQ. The OP-AMP feedback loop, which includes PWM 34, switches 35 and 36, and inductor 37, operates to make the voltage difference between the positive and negative input as close to zero as possible, so that the negative input and therefore VTT are regulated to substantially close to one half of the VDDQ voltage.

Further, it is well known by those skilled in the art that a buck converter, operating in a continuous inductor current mode, is capable of both sourcing current to and sinking current from its output. Specifically, if a greater number of lines are low, the buck converter 30 supplies positive output current to the VTT voltage 39, and thus to the data bus lines, which causes the voltage VTT to drop slightly from 1.25 Volts. On the other hand, if a greater number of lines are high, a net current flows from the data bus lines to VTT capacitor 38, which causes the VTT voltage to rise slightly above 1.25V. The buck converter 30 then operates as a boost converter, in the reverse direction, pumping current from capacitor 38 back to VDDQ via transistor switch 35 or its body diode.

The bi-directional current flow of a synchronous buck converter is illustrated in the waveforms of FIGS. 3A–3D. FIG. 3A shows the turn-on pulses of switch 35 Ql. During switch 35 turn-on time, switch 36 Q2 is turned off. FIG. 3B shows the turn-on pulses of switch 36, which correspond to the turn-off time of switch 35.

If there is a net outflow of current from the VTT to the data bus, the buck converter 30 sources a positive output current, Iout. FIG. 3C shows the inductor current waveform when buck converter 30 is sourcing an output current to VTT 39. During switch 35 turn-on time, inductor current lout ramps up with a rate of about (VDDQ−VTT)/L Amps/second. During switch 35 turn-off time (turn-on time of switch 36), the inductor current lout ramps down with a rate of about VTT/L Amps/second. Because VTT is approximately ½ VDDQ, the ramp up and ramp down rates are approximately equal.

If there is a net inflow of current, buck converter 30 receives current from VTT 39, behaving like a boost converter in the reverse direction. FIG. 3D shows the inductor current waveform when buck converter 30 is sinking current. When switch 36 turns on, inductor current builds up its magnitude in a reverse direction. For example, Iout ramps from −0.45A to−0.55A. During switch 36 off time, the reverse inductor current flows from output capacitor 38 back to VDDQ, through the conduction of switch 35 and its body diode. The reverse inductor current decreases its magnitude, since it flows into a higher voltage, VDDQ.

A synchronous buck converter has a very high power conversion efficiency but requires a power inductor which increases the space and cost of the system. Furthermore, the inductor has a leakage magnetic field which generates electromagnetic noise in other components and circuits in close proximity to the inductor.

Thus, there is a need for a regulator circuit that uses no inductor components, but is capable of sinking and sourcing current while providing a regulated termination voltage.

BRIEF SUMMARY OF THE INVENTION

One embodiment of the present invention includes a voltage regulator for providing a bidirectional current and a regulated voltage to a load. The voltage regulator includes a voltage divider circuit, a first linear regulator and a second linear regulator. The voltage divider circuit is configured to provide a regulated output voltage that is approximately half of an input voltage when the output voltage is within a voltage range set by a first predetermined level and a second predetermined level, and to provide current to the load and receiving current from the load, as needed by the load. The first linear regulator is connected to receive the input voltage, and is configured to provide additional current to the load if the regulated output voltage falls to the first predetermined level and to clamp the output voltage at the first predetermined level. The second linear regulator is configured to receive additional current from the load if the regulated output voltage exceeds the second predetermined level and to clamp the output voltage at the second predetermined level.

One advantage of the present invention is that it achieves a bi-directional regulation of a termination voltage to exactly one half the input voltage level.

Another advantage is that the present invention provides bi-directional regulation of its output voltage, by sourcing and sinking current, without using any inductor components.

Yet another advantage of the present invention is that it provides a high-efficiency power conversion, since essentially, no resistive components are used in the voltage regulator circuit.

BRIEF DESCRIPTION OF THE DRAWINGS

These and other features, aspects and advantages of the present invention will become better understood with regard to the following description, appended claims, and accompanying drawings where:

DETAILED DESCRIPTION OF THE INVENTION

The present invention uses a voltage doubler circuit in reverse to create a VTT voltage that is half of the VDDQ supply voltage. Reversing a voltage doubler circuit is an ideal way to generate a termination voltage (VTT) from a VDDQ input voltage, where the output VTT voltage is to be maintained at one half of the VDDQ voltage.

Figure 1A:
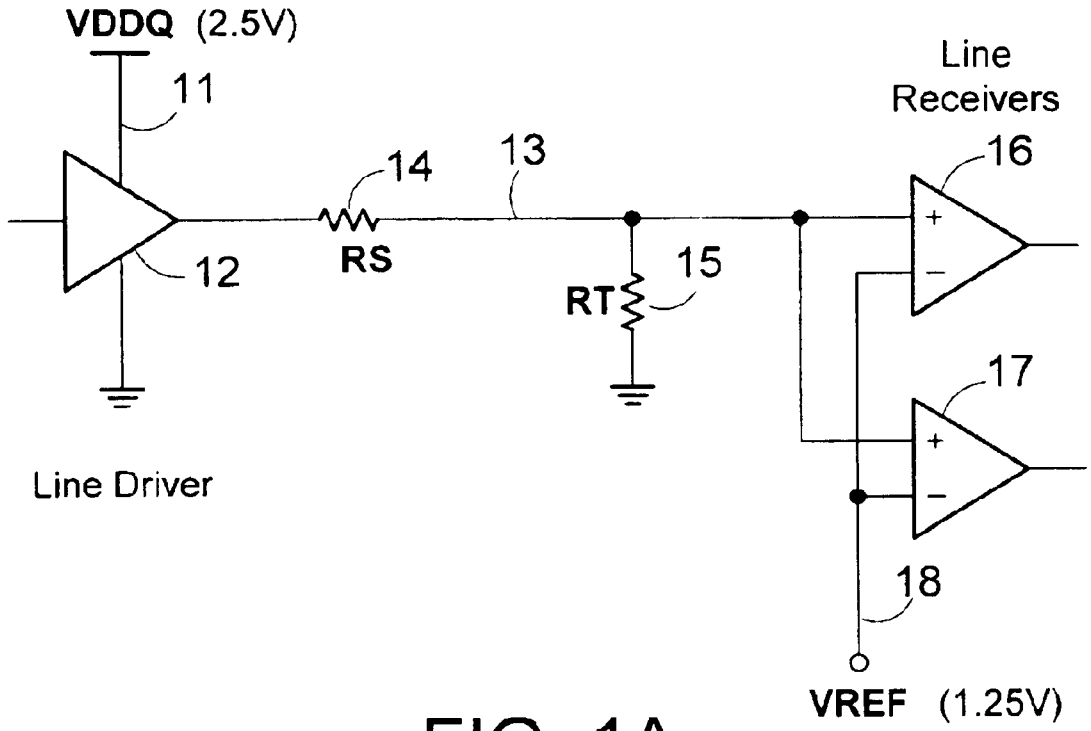
FIG. 1A (Prior Art)
FIG. 1A shows a data bus line termination scheme with a termination resistor connected between a data bus line and the ground.
Figure 1B:
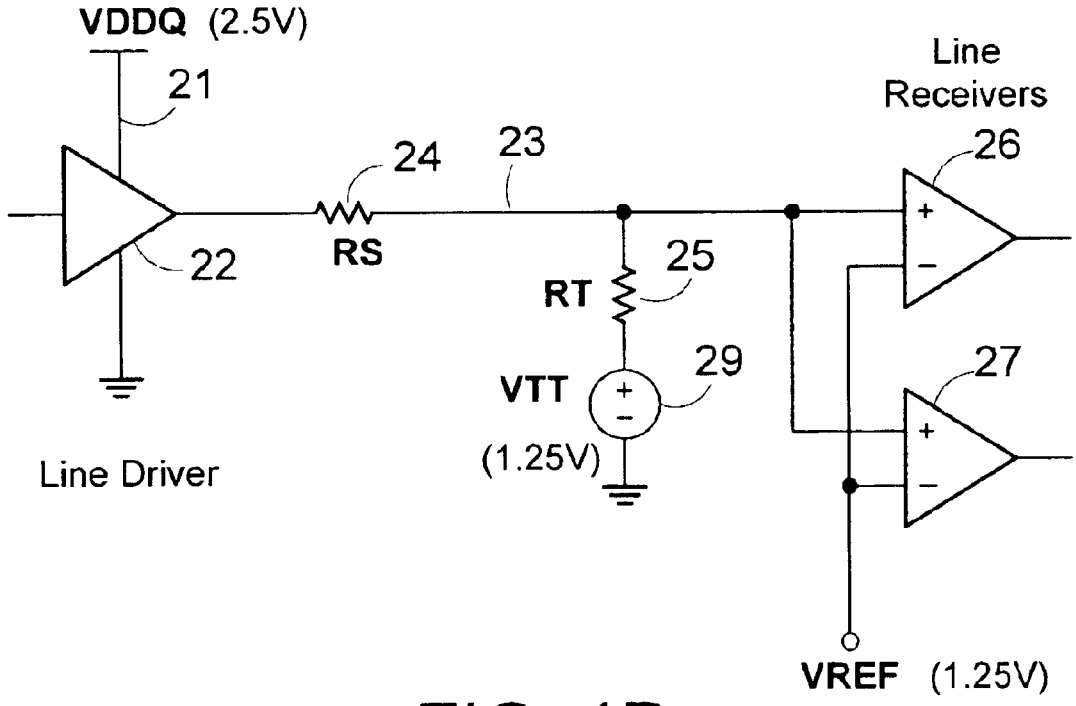
FIG. 1B (Prior Art)
FIG. 1B shows a data bus line termination scheme with a termination resistor connected between a data bus line and a termination voltage.
Figure 2:
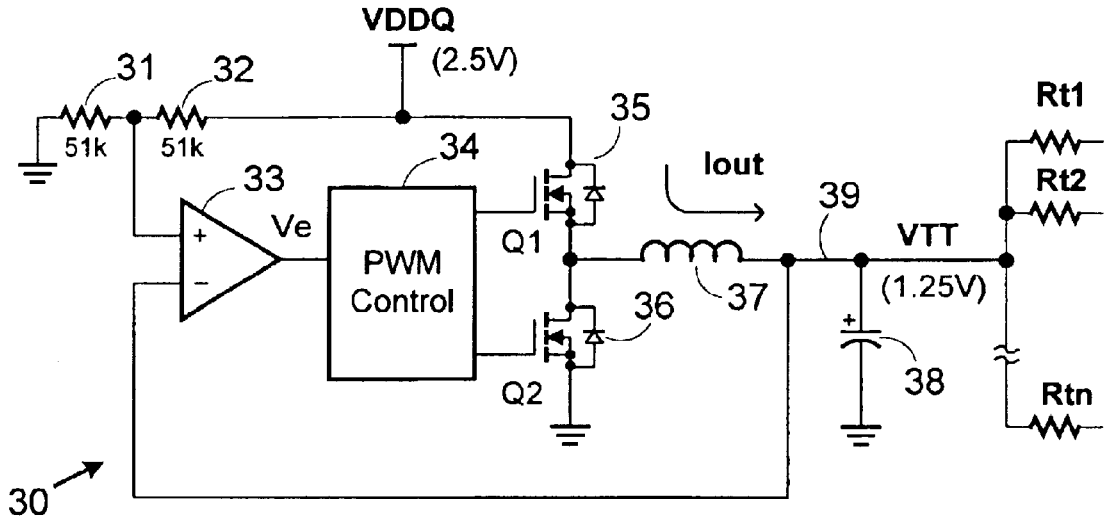
FIG. 2 (Prior Art)
FIG. 2 shows a conventional synchronous buck converter capable of sourcing current to and sinking current from an output that is regulated at one half of the input voltage level.
Figures 3A, 3B, 3C, 3D:
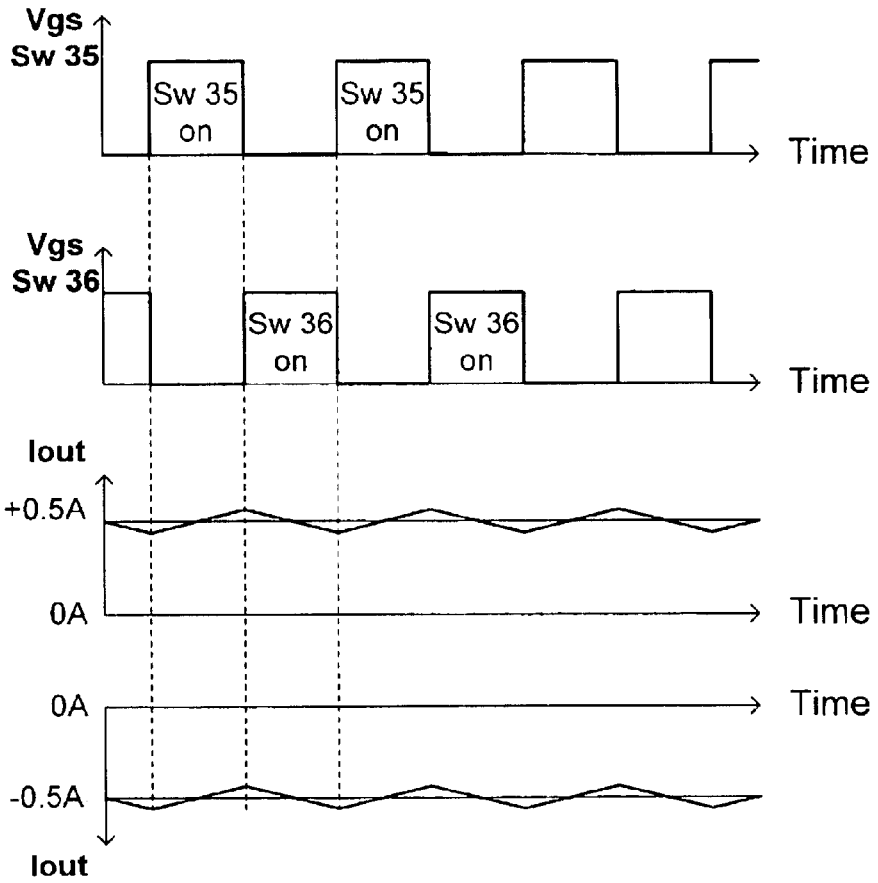
FIG. 3A (Prior Art)
FIG. 3B (Prior Art)
FIG. 3C (Prior Art)
FIG. 3D (Prior Art)
FIGS. 3A–3D show the key waveforms of the FIG. 2 circuit.
Figure 4:
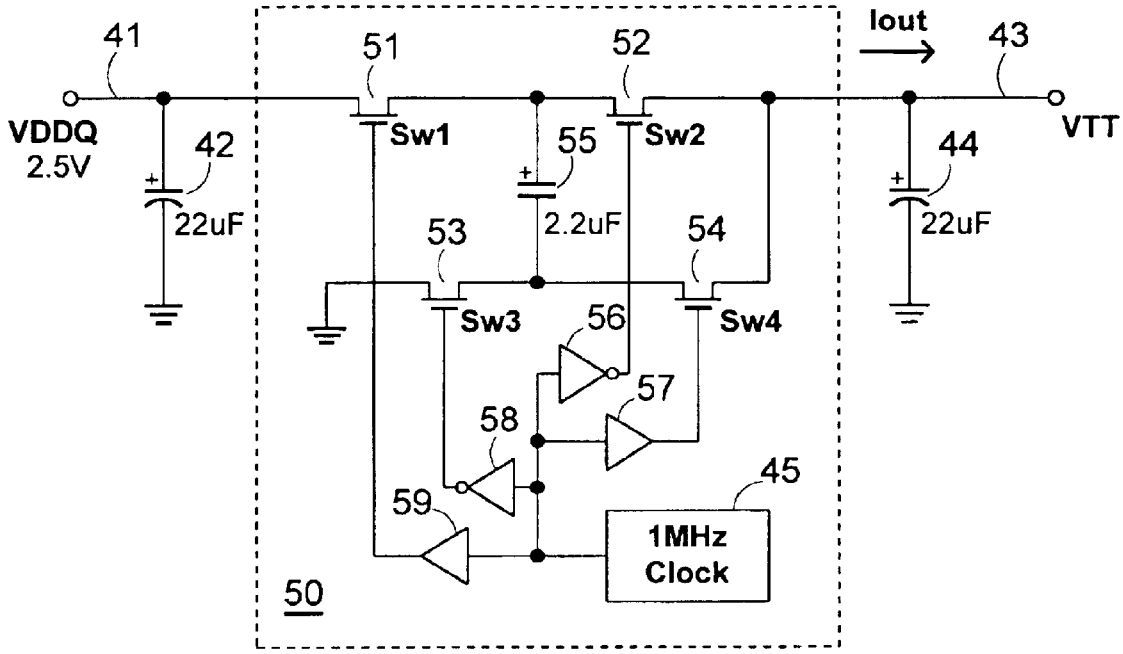
FIG. 4 shows an embodiment of the present invention.

FIG. 4 shows one embodiment of the present invention. A voltage regulator circuit 50, is connected between an input voltage node 41 and an output voltage node 43. The input voltage node is connected to a filter capacitor 42, and the output voltage node is connected to a filter capacitor $C_{out}$ 44, which has a value of about 22 uF, in one embodiment of the invention. Filter capacitor 44 is used to store energy for the load and to reduce switching ripple.

The voltage regulator circuit 50 includes a capacitor $C_b$ 55, which has a value of about 4.7 uF in one embodiment of the invention, four MOSFET switches, 51, 52, 53, 54, and respective gate driver circuits 56, 57, 58, 59. A high frequency clock 45, e.g., 1 MHz, is connected to the inputs of the four gate driver circuits. Gate drivers 57 and 59 operate in parallel during one phase of the clock and gate drivers 56 and 58 operate in parallel during another phase of the clock.

In the case where a majority of data lines are in a low state, VTT node 43 provides current to the load, i.e., the terminators of the data bus system. Providing current to the load causes the voltage on capacitor $C_{out}$ 44 to drop slightly below one half of VDDQ 41's level which, in turn, causes voltage regulator circuit 50 to supply energy to capacitor $C_{out}$ 44, to prevent VTT from dropping further.

In the steady state, after clock circuit 45 issues a new pulse, gate drivers 57, 59 output high states, gate drivers 56, 58 output low states, turning on switches 51 and 54, turning off switches 52, 53, and connecting capacitor $C_b$ 55 in series with the output capacitor $C_{out}$ 44. Because the output capacitor $C_{out}$ 44has a voltage slightly lower than one half of VDDQ voltage, VDDQ 41 charges capacitor $C_b$ 55 to slightly more than one half of VDDQ level to make the sum of the voltages on $C_{out}$ and $C_b$ equal to VDDQ.

At the end of the pulse, gate drivers 57 and 59 transition low, turning off switches 51 and 54 and turning on switches 52 and 53. Capacitor $C_b$ 55 is now connected in parallel with output capacitor $C_{out}$ 44. Because capacitor $C_b$ 55 is charged to a voltage slightly more than one half of VDDQ level and output capacitor 44 has a voltage slightly less than one half of VDDQ level, capacitor $C_b$ 55 now transfers an amount of charge to the output capacitor $C_{out}$ 44. This cycle of charging capacitor $C_b$ 55, during the pulse and transferring charge from $C_b$ 55 to output capacitor $C_{out}$ 44 after the pulse, continues until the voltages on the two capacitors equalize, at which point the output voltage equals approximately one half of the VDDQ level while providing current to the load.

In the case where a majority of data lines are in the high state, VTT 43 receives current from the load. This causes the voltage on output capacitor $C_{out}$ 44 to rise above one half of VDDQ 41's level and the voltage regulator circuit to pump energy from capacitor $C_{out}$ 44 back to input capacitor $C_{in}$ 42 to prevent VTT 43 from rising further. In a steady state, before clock circuit 45 issues a new pulse, gate drivers 56 and 58 output high states, turning on switches 52 and 53 and connecting capacitor $C_b$ 55 in parallel with output capacitor $C_{out}$ 44. Because output capacitor $C_{out}$ 44 has a voltage higher than one half of VDDQ voltage, the output capacitor $C_{out}$ 44 charges the capacitor $C_b$ 55 to a voltage slightly higher than one half of VDDQ. At the end of the pulse, gate drivers 56 and 58 transition low, gate drivers 57 and 59 transition high, turning off switches 52 and 53 and turning on switches 51 and 54. The capacitor $C_b$ 55 is now connected in series with output capacitor $C_{out}$ 44 and the sum of capacitor $C_b$ 55 voltage and $C_{out}$ 44 voltage is slightly greater than VDDQ level. Under this condition, capacitor $C_b$ 55 transfers charge to input capacitor $C_{in}$ 42. By repeated charging and discharging of capacitor $C_b$ 55, energy is pumped back from output capacitor $C_{out}$ 44 to input capacitor $C_{in}$ 42, the output voltage VTT is maintained at about one half of VDDQ while current is received from the load.

It is clear that voltage regulator circuit 50 is a true bi-directional power conversion circuit. It automatically sources current to or sinks current from the output capacitor 44, and regulates output voltage VTT 43 at about one half of the input voltage level. However, the voltage conversion efficiency of a voltage doubler or a voltage splitter is always less than 100% due to the equivalent on-resistance (Rds) of the MOSFET switches and equivalent series resistances (ESRs) of input capacitor 42, output capacitor 44, and capacitor $C_b$ 55.

Figure 5:
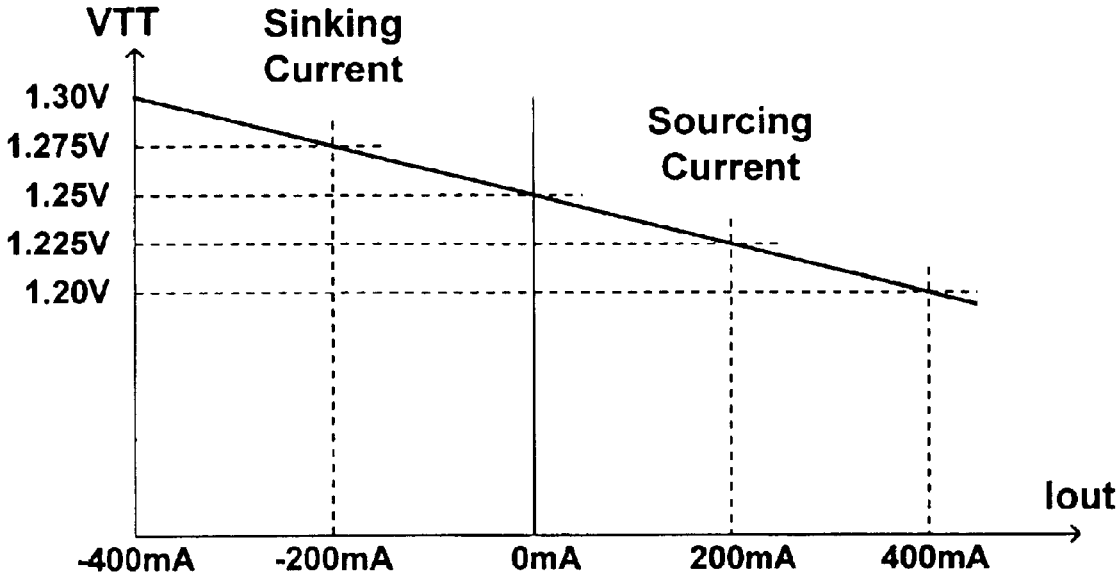
FIG. 5 shows the voltage regulation characteristics of the voltage regulator circuit as shown in FIG. 4.

FIG. 5 shows the voltage regulation characteristics of the bidirectional voltage regulator circuit 50. When the voltage regulator circuit is not sourcing or sinking any current, VTT is maintained substantially close to one half of VDDQ level, or 1.25V. When the output capacitor 44 provides a higher net current to the load, the voltage regulator circuit increases its energy transfer from the VDDQ node to the VTT node. Sourcing a higher net current to the load increases voltage drops across the power switches and ESRs of capacitors. For example, FIG. 5 shows that, when the voltage regulator circuit is sourcing 200 mA, VTT drops 25 mV to 1.225 V. When sourcing 400 mA, VTT drops further to 1.20V. Thus, the voltage regulator circuit has an equivalent impedance of about 25 mV/200 mA=0.125 Ω.

Similarly, when sinking current (pumping energy back to VDDQ), the voltage regulator circuit loses some voltage conversion efficiency. For example, when VTT is at 1.275V, the sinking current is 200 mA. If VTT increases to 1.30V, the voltage regulator circuit pumps more current, 400 mA, back to the VDDQ supply.

Thus, while the voltage regulator circuit is effective to transfer energy in either direction, it is not efficient for high current applications. The voltage conversion efficiency is substantially reduced when the load current is above about 300 mA.

In DDR DRAM termination voltage applications, measurements show the average VTT current, sourcing or sinking, is less than about 200 mA. However, there are occasional short duration, spikes of up to 1.5 Amps in the load current.

Figure 6:
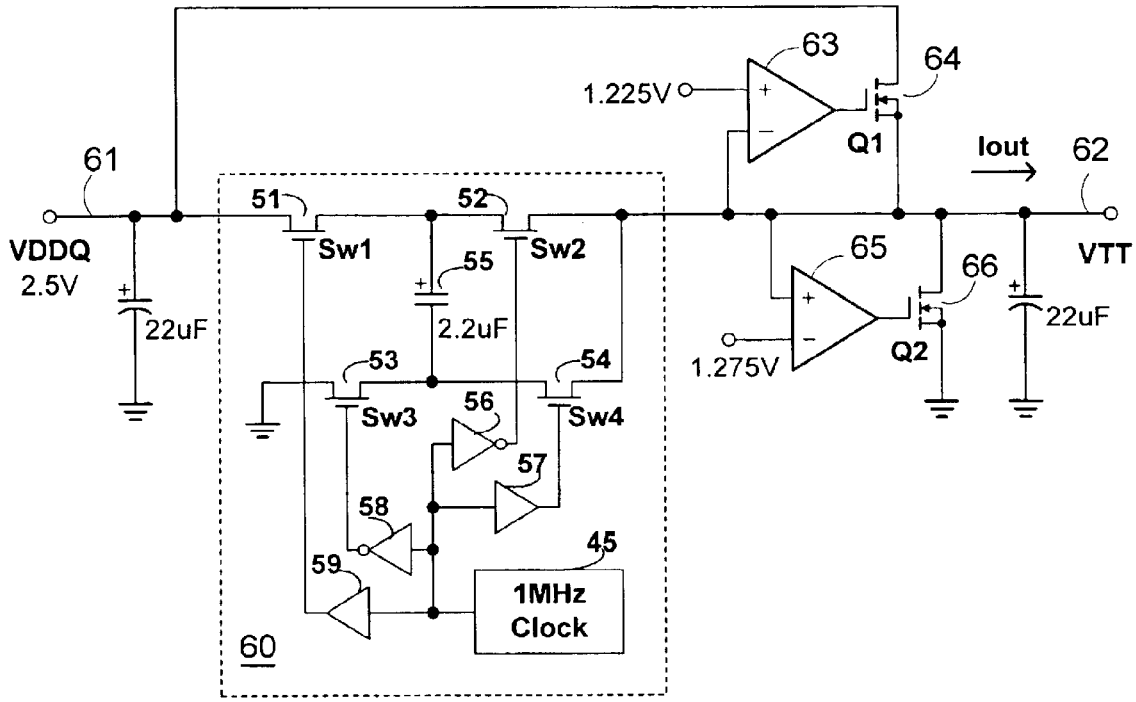
FIG. 6 shows a second embodiment of the present invention with high-current voltage clamp circuit.

To prevent the VTT voltage from dropping below the lower regulation limit, for example, 1.225V, or exceeding the higher regulation limit in high current situations, for example, 1.275V, a second embodiment of the present invention is implemented, as shown in FIG. 6.

The voltage regulator circuit 60 is similar to the voltage regulator circuit 50 of FIG. 4. his voltage regulator circuit 60 regulates the output voltage 62 with a source or sink current of 200 mA and a voltage change of about 25 mV. Also included are two linear regulators capable of sourcing or sinking excessive spike currents. The first linear regulator includes MOSFET 64 and OP-AMP 63. The positive input of OP-AMP 63 is connected to a reference voltage of 1.225 V. When VTT 62 begins to drop below 1.225 V when it is sourcing a large current to the load, O-PAMP 63 turns on MOSFET 64 and provides a high current path from VDDQ to VTT. OP-AMP 63 and MOSFET 64 together act like a linear regulator to maintain VTT at 1.225V for sourcing current up to 1.5A.

The second linear regulator includes MOSFET 66 and OP-AMP 65. The negative input of OP-AMP 65 is connected to a reference voltage of 1.275V. When VTT 62 begins to rise above 1.275V when it is sinking a large current from the load, OP-AMP 65 turns on MOSFET 66 and provides a high current path from VTT to ground. OP-AMP 65 and MOSFET 66 together act like a shunt regulator to maintain VTT at 1.275V for sinking current up to 1.5A.

Upper reference voltage (1.275 V) and lower reference voltage (1.225 V) depend to a large extent on the effective impedance of the voltage regulator circuit and may be different for circuits having different effective impedances.

Figure 7:
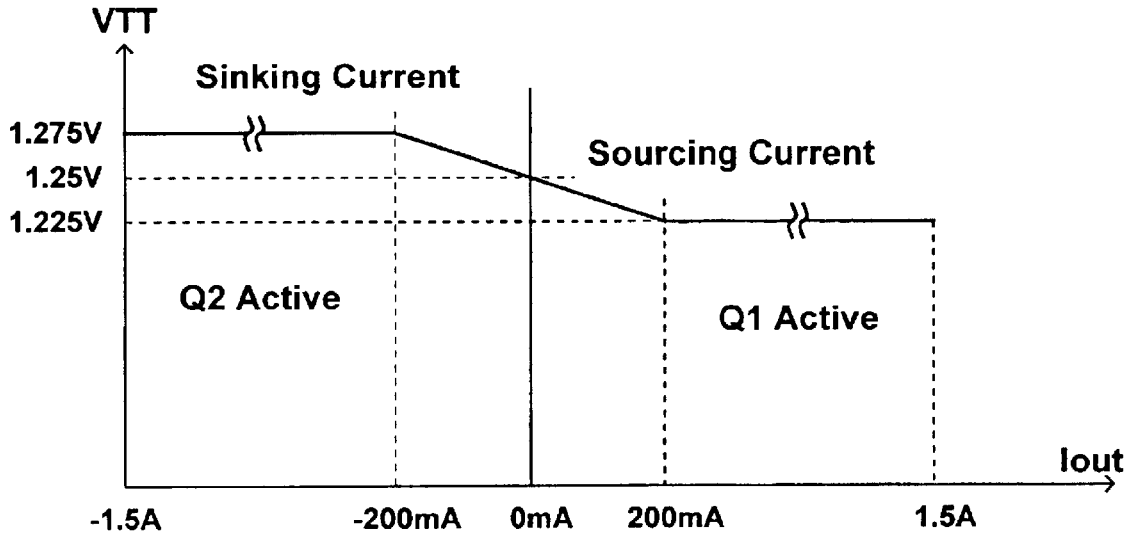
FIG. 7 shows the voltage regulation characteristics of the FIG. 6 regulator circuit.

FIG. 7 shows the voltage regulation characteristics of the hybrid regulator of FIG. 6. For sourcing or sinking current less than 200 mA, only the voltage regulator circuit 60 is active. When sourcing current, the voltage regulator circuit behaves like a voltage splitter. Power conversion efficiency is very high, in the order of 90%. When sinking current, the voltage regulator circuit behaves like a voltage doubler. Energy is recovered and transferred from VTT 62 back to VDDQ 61. Power conversion efficiency is very high, also in the order of 90%.

However, if the load demands more current from VTT 62, OP-AMP 63 activates MOSFET 64, sourcing up to 1.5 A from VDDQ 61, while regulating (or clamping) VTT 62 at 1.225 V. On the other hand, if the load requires a large sink current from VTT 62, OP-AMP 65 activates MOSFET 66, sinking up to 1.5A current to ground, while regulating (or clamping) VTT 62 at 1.275V.

It is well known that linear regulators do not provide high efficiency. For example, when sourcing current from a 2.5 V VDDQ 61 to a 1.25VTT 62, the power efficiency is only 50%. Further, when sinking current from the 1.25V VTT 62 to ground, no energy is recovered and transferred back to VDDQ 61. The power efficiency is essentially zero.

Fortunately, in DDR DRAM termination voltage applications, the average VTT current, sourcing or sinking, is less than 200 mA most of the time. As a result, using additional shunt regulators to regulate VTT voltage during spike current conditions does not significantly penalize the overall power conversion efficiency.

Although the present invention has been described in considerable detail with reference to certain preferred versions thereof, other versions are possible. Therefore, the spirit and scope of the appended claims should not be limited to the description of the preferred versions contained herein.

What is claimed is:

1. A voltage regulator for providing a bidirectional current and a regulated voltage to a load, the voltage regulator comprising:

a voltage divider circuit for providing a regulated output voltage that is approximately half of an input voltage when the output voltage is within a voltage range set by a first predetermined level and a second predetermined level, and for providing current to the load and receiving current from the load, as needed by the load;

a first linear regulator connected to receive the input voltage, and configured to provide additional current to the load if the regulated output voltage falls to the first predetermined level and to clamp the output voltage at the first predetermined level;

a second linear regulator configured to receive additional current from the load if the regulated output voltage exceeds the second predetermined level and to clamp the output voltage at the second predetermined level.

2. A voltage regulator for providing a bidirectional current and a regulated voltage to a load, the voltage regulator comprising:

means for providing a regulated output voltage that is approximately half of an input voltage, when the output voltage is within a voltage range set by a first predetermined level and a second predetermined level, and for providing current to the load and receiving current from the load, as needed by the load;

means for providing additional current to the load and for maintaining the output voltage at the first predetermined level, if the regulated output voltage falls to the first predetermined level; and means for receiving additional current from the load and maintaining the output voltage at the second predetermined level if the regulated output voltage rises to the second predetermined level.

3. A voltage regulator for providing a bidirectional current and a regulated voltage to a load, the voltage regulator comprising:

a capacitor having a first node and a second node;

first and second switches, each having a control input that operates the switch, the first switch connected between a node with an input voltage and a first node of the capacitor, the second switch connected between a node carrying the regulated output voltage and the second node of the capacitor;

third and fourth switches, each having a control input that operates the switch, the third switch connected between the output voltage node and the first node of the capacitor, the fourth switch connected between the second node of the capacitor and ground;

first and second drivers, the first and second drivers each having inputs for receiving an external clock signal, the external clock signal-having a first phase and a second phase, the first driver connected to the control input of the first switch and operative to close the first switch on the first phase of the clock signal, the second driver connected to the control input of the second switch and operative to close the second switch on the first phase of the clock signal;

third and fourth drivers, the third and fourth drivers each having inputs for receiving the external clock signal, the third driver connected to the control input of the third switch and operative to close the third switch on the second phase of the clock signal, the fourth driver connected to the control input of the fourth switch and operative to close the fourth switch on the second phase of the clock signal;

wherein the first, second, third and fourth drivers, the first, second, third and fourth switches and the capacitor are operative to regulate the output voltage at one-half of the input voltage, when the output voltage is within a range set by a first predetermined voltage and a second predetermined voltage;

first transistor having a source and drain, a conduction channel formed therebetween being connected between the input voltage node and the output voltage node, and a gate input;

second transistor having a source and drain, a conduction channel formed therebetween being connected between the output voltage node and ground, and a gate input;

first operational amplifier having an input for receiving the first predetermined voltage, an input connected to the output voltage node and output connected to the gate of the first transistor, the first operational amplifier and first transistor for maintaining the output voltage at the first predetermined voltage when the output voltage falls to the first predetermined voltage;

second operation amplifier having an input for receiving the second predetermined voltage, an input connected to the output voltage node and output connected to the gate of the second transistor, the second operational amplifier and second transistor for maintaining the output voltage at the second predetermined voltage when the output voltage rises to the second predetermined voltage.

4. A method for providing a bidirectional current and a regulated voltage to a load, the method comprising:

connecting a first node of a first capacitor to an input voltage and the second node of the first capacitor to the first node of a second capacitor during a first phase of an external clock signal, the second capacitor having a second node connected to a ground return, the regulated output voltage being present on the first node of the second capacitor; and connecting the first node of the first capacitor to the first node of the second capacitor and the second node of the first capacitor to the ground return during the second phase of an external clock signal, thereby providing bidirectional current to the load and maintaining the regulated output voltage at half of the input voltage.

5. A method for providing a bidirectional current and a regulated voltage to a load, as recited in claim 4, further comprising the step of maintaining the output voltage at a predetermined level if the output voltage falls to the predetermined level and providing additional current to the load.

6. A method for providing a bidirectional current and a regulated voltage to a load, as recited in claim 5, further comprising the step of maintaining the output voltage at another predetermined level if the output voltage rises to the other predetermined level and receiving additional current from the load.

7. A method for providing a bidirectional current and a regulated voltage to a load, as recited in claim 4, further comprising the step of maintaining the output voltage at a predetermined level if the output voltage rises to the predetermined level and receiving additional current from the load.

8. A process for providing a bidirectional current and a regulated voltage to a load using a voltage-doubler circuit, the process comprising the steps of:

connecting a first node of a first capacitor to an input voltage and the second node of the first capacitor to the first node of a second capacitor during a first phase of an external clock signal, the second capacitor having a second node connected to a ground return, the regulated output voltage being present on the first node of the second capacitor; and connecting the first node of the first capacitor to the first node of the second capacitor and the second node of the first capacitor to the ground return during the second phase of an external clock signal, thereby providing a bidirectional current to the load and maintaining an output voltage at half of the input voltage.

9. A method for providing a bidirectional current and a regulated voltage to a load, as recited in claim 8, further comprising the step of maintaining the output voltage at a predetermined level if the output voltage falls to the predetermined level and providing additional current to the load.

10. A method for providing a bidirectional current and a regulated voltage to a load, as recited in claim 9, further comprising the step of maintaining the output voltage at another predetermined level if the output voltage rises to the other predetermined level and receiving additional current from the load.

11. A method for providing a bidirectional current and a regulated voltage to a load, as recited in claim 8, further comprising the step of maintaining the output voltage at a predetermined level if the output voltage rises to the predetermined level and receiving additional current from the load.

* * * * *